US011820558B2

(12) United States Patent
Lin

(10) Patent No.: US 11,820,558 B2
(45) Date of Patent: Nov. 21, 2023

(54) CONTAINER FOR COSMETICS

(71) Applicant: LIBO COSMETICS CO., LTD., Taichung (TW)

(72) Inventor: Hsiao-Yun Lin, Taichung (TW)

(73) Assignee: LIBO COSMETICS CO., LTD., Taichung (TW)

( * ) Notice: Subject to any disclaimer, the term of this patent is extended or adjusted under 35 U.S.C. 154(b) by 1 day.

(21) Appl. No.: 17/367,608

(22) Filed: Jul. 5, 2021

(65) Prior Publication Data

US 2023/0002123 A1 Jan. 5, 2023

(51) Int. Cl.
*B65D 43/02* (2006.01)
*A45D 40/00* (2006.01)

(52) U.S. Cl.
CPC ..... *B65D 43/02* (2013.01); *A45D 40/00* (2013.01); *A45D 2040/0025* (2013.01); *A45D 2200/05* (2013.01); *B65D 2313/04* (2013.01)

(58) Field of Classification Search
CPC B65D 43/02; B65D 2313/04; B65D 2313/02; B65D 11/16; B65D 11/26; B65D 15/24; B65D 15/18; B65D 15/16; B65D 25/101; B65D 25/105; B65D 25/103; B65D 25/107; B65D 43/08; B65D 43/12; B65D 51/18; B65D 43/06; B65D 2251/0021; B65D 2251/0018; B65D 2543/0064; B65D 51/32; B65D 41/02; B65D 1/0246; B65D 43/20; B65D 39/0052; B65D 41/16; B65D 2251/0015; B65D 2251/0075; A45D 40/00; A45D 2040/0025; A45D 2200/05; A45D 40/02; A45D 2040/0018
USPC ..... 220/230, 223, 222, 221, 710, 890; 206/581, 818
See application file for complete search history.

(56) References Cited

U.S. PATENT DOCUMENTS

| | | | | |
|---|---|---|---|---|
| 8,556,527 | B1 * | 10/2013 | Chou | A45D 40/04 401/98 |
| 9,592,935 | B1 * | 3/2017 | Jacob | B65D 41/0407 |
| 10,945,510 | B2 * | 3/2021 | Wolfe | B65D 51/32 |
| 2011/0073601 | A1 * | 3/2011 | Komatsuda | A45D 40/18 220/230 |
| 2015/0237990 | A1 * | 8/2015 | Lin | A45D 40/04 401/78 |

FOREIGN PATENT DOCUMENTS

| | | | | |
|---|---|---|---|---|
| CH | 658438 A | * | 11/1986 | B65D 51/14 |
| CN | 207979222 U | * | 10/2018 | A45D 40/00 |
| KR | 20180049116 A | * | 5/2018 | B65D 1/0246 |

* cited by examiner

*Primary Examiner* — Valentin Neacsu
*Assistant Examiner* — John Martin Hoppmann
(74) *Attorney, Agent, or Firm* — BRUCE STONE LLP; Joseph A. Bruce

(57) ABSTRACT

A container includes a cover assembly, a base assembly, magnets and a ferromagnetic element. The cover assembly includes an edge extending around an open end. The base assembly includes an open end inserted in the cover assembly via the open end of the cover assembly when the edge of the cover assembly covers the open end of the base assembly. The magnets are connected to the cover assembly or the base assemblies while the ferromagnetic element is connected to the base assembly or the cover assembly. The magnets are operable to magnetically attract the ferromagnetic element to keep the cover assembly covering the open end of the base assembly.

7 Claims, 8 Drawing Sheets

CONTAINER FOR COSMETICS

BACKGROUND OF INVENTION

1. Field of Invention

The present invention relates to cosmetics and, more particularly, to a container for cosmetics.

2. Related Prior Art

A typical container for cosmetics includes a case and a cover. The case is used to contain a lipstick or lip gloss. The cover is engaged with the case to keep the lipstick or lip gloss in the case.

The cover can be engaged with the case in various manners such as threads and magnets. Where threads are used, the case is formed with a thread for engagement with a thread formed on the cover. The cover has to be rotated relative to the case for a certain angle in a direction to engage the cover with the case adequately. The cover has to be rotated relative to the case for the angle in an opposite direction to disengage the cover from the case. Such rotation is a waste of time.

Where magnets are used, one of the magnets is connected to the case and the remaining one of the magnets is connected to the cover. The magnets attract each other to keep the cover on the case. The engagement of the cover with the case and the disengagement of the cover from the case are convenient. However, each of the magnets must be connected to the cover or the case in a correct position or the magnets would repulse each other instead of attract each other. The attachment of each of the cover or the case is troublesome for a worker.

The present invention is therefore intended to obviate or at least alleviate the problems encountered in the prior art.

SUMMARY OF INVENTION

It is the primary objective of the present invention to provide a magnetic container that is manufactured efficiently.

To achieve the foregoing objective, the magnetic container includes a cover assembly, a base assembly, magnets and a ferromagnetic element. The cover assembly includes an edge extending around an open end. The base assembly includes an open end inserted in the cover assembly via the open end of the cover assembly when the edge of the cover assembly covers the open end of the base assembly. The magnets are connected to the cover assembly or the base assemblies while the ferromagnetic element is connected to the base assembly or the cover assembly. The magnets are operable to magnetically attract the ferromagnetic element to keep the cover assembly covering the open end of the base assembly.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
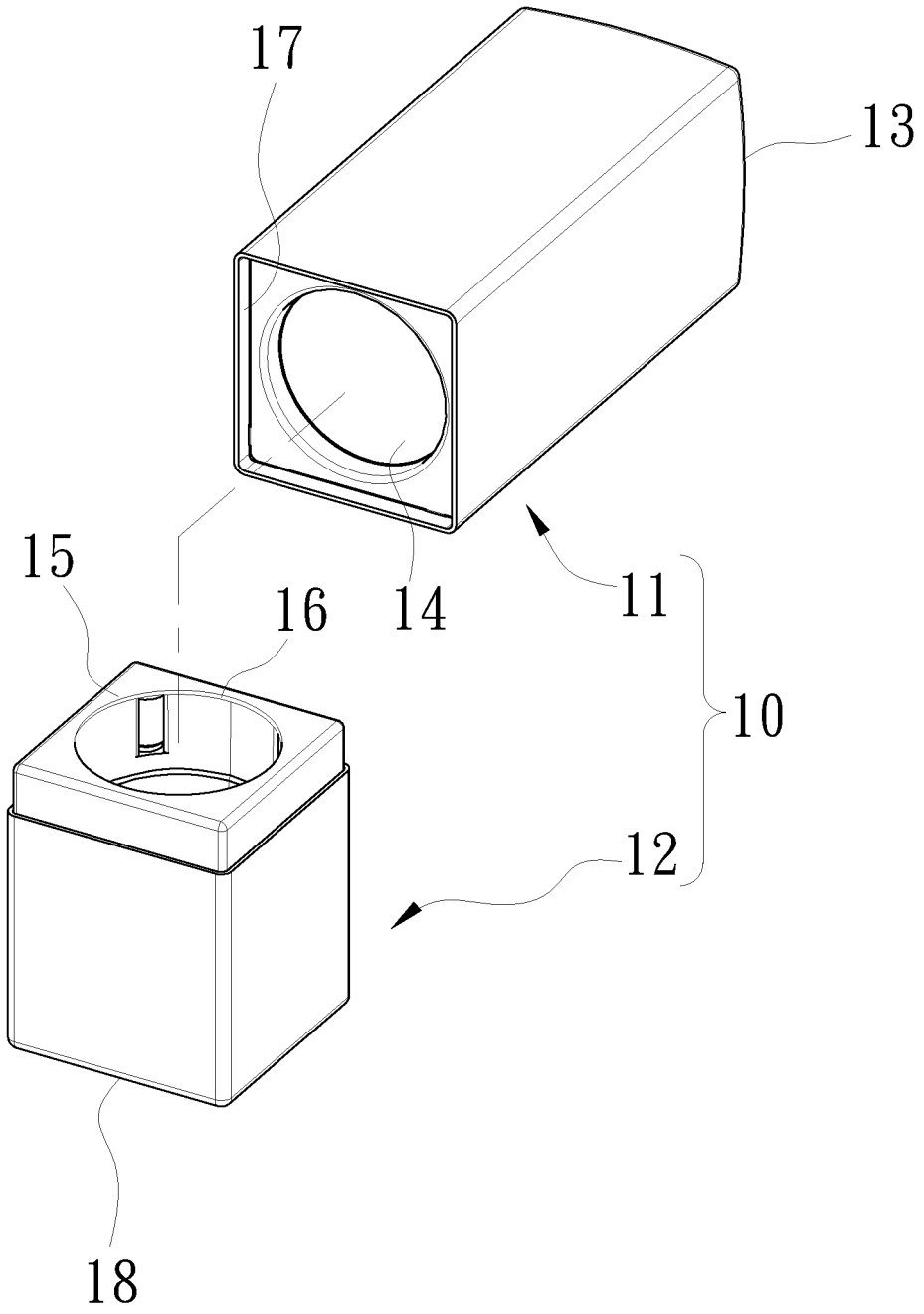
FIG. 1 is a perspective view of a container according to the preferred embodiment of the present invention.

Referring to FIG. 1, a magnetic container 10 includes a cover assembly 11 and a base assembly 12 according to the preferred embodiment of the present invention. The cover assembly 11 is in the form of a square in a cross-sectional view. The cover assembly 11 includes a closed end 13, an open end 14, and four edges 17 around the open end 14 of the cover assembly 11. The base assembly 12 is also in the form of a square in a cross-sectional view. The base assembly 12. The base assembly 12 includes an open end 15 and a closed end 18.

Figure 8:
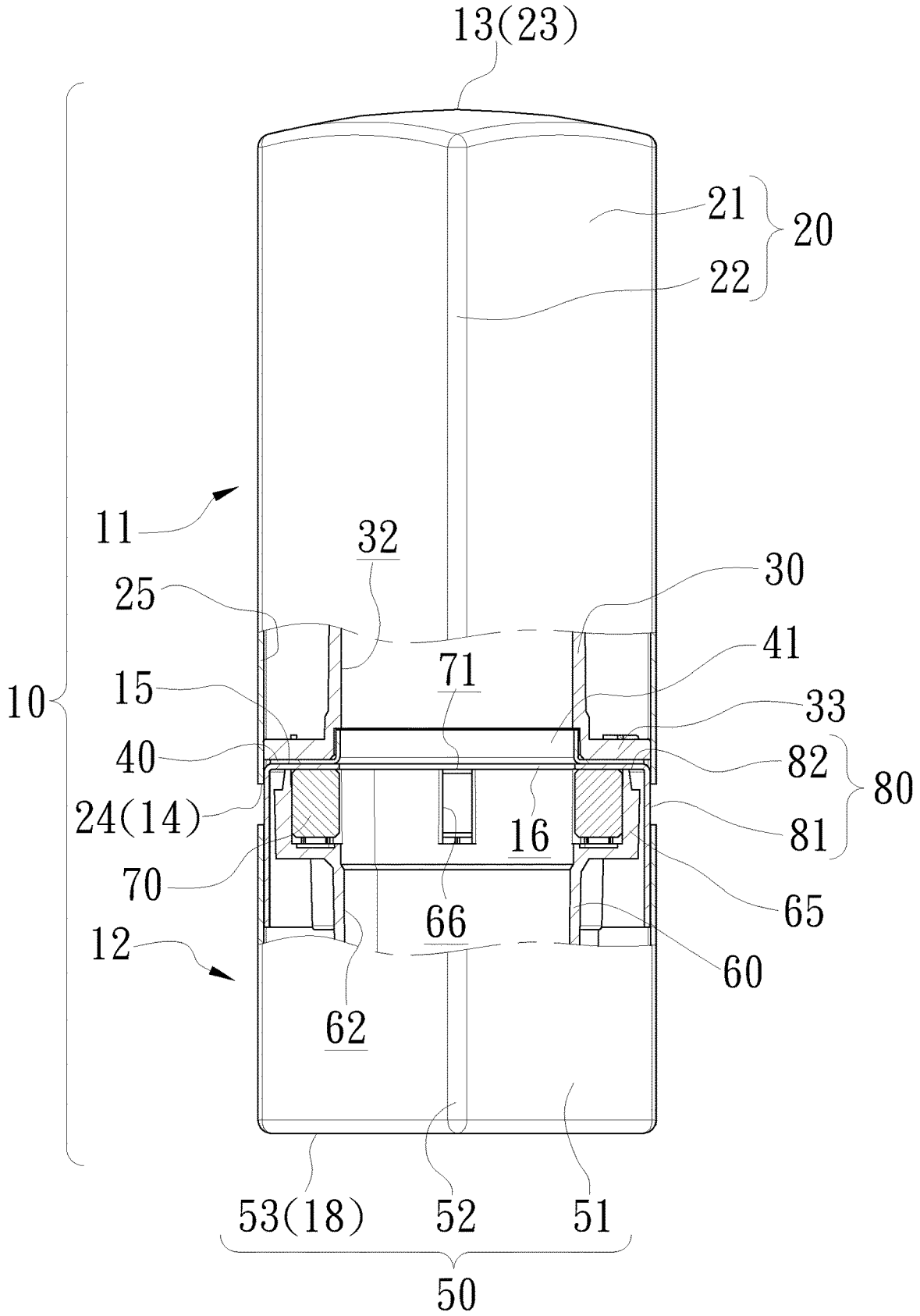
FIG. 8 is a cut-away view of the container in another position than shown in FIG. 1.

Referring to FIG. 8, the cover assembly 11 can be connected to the base assembly 12 to keep cosmetics such as lip gloss in the container 10. The open end 15 of the base assembly 12 is inserted in the cover assembly 11 through the open end 14 of the cover assembly 11. The edges 17 are located around the open end 15 of the base assembly 12.

Figure 2:
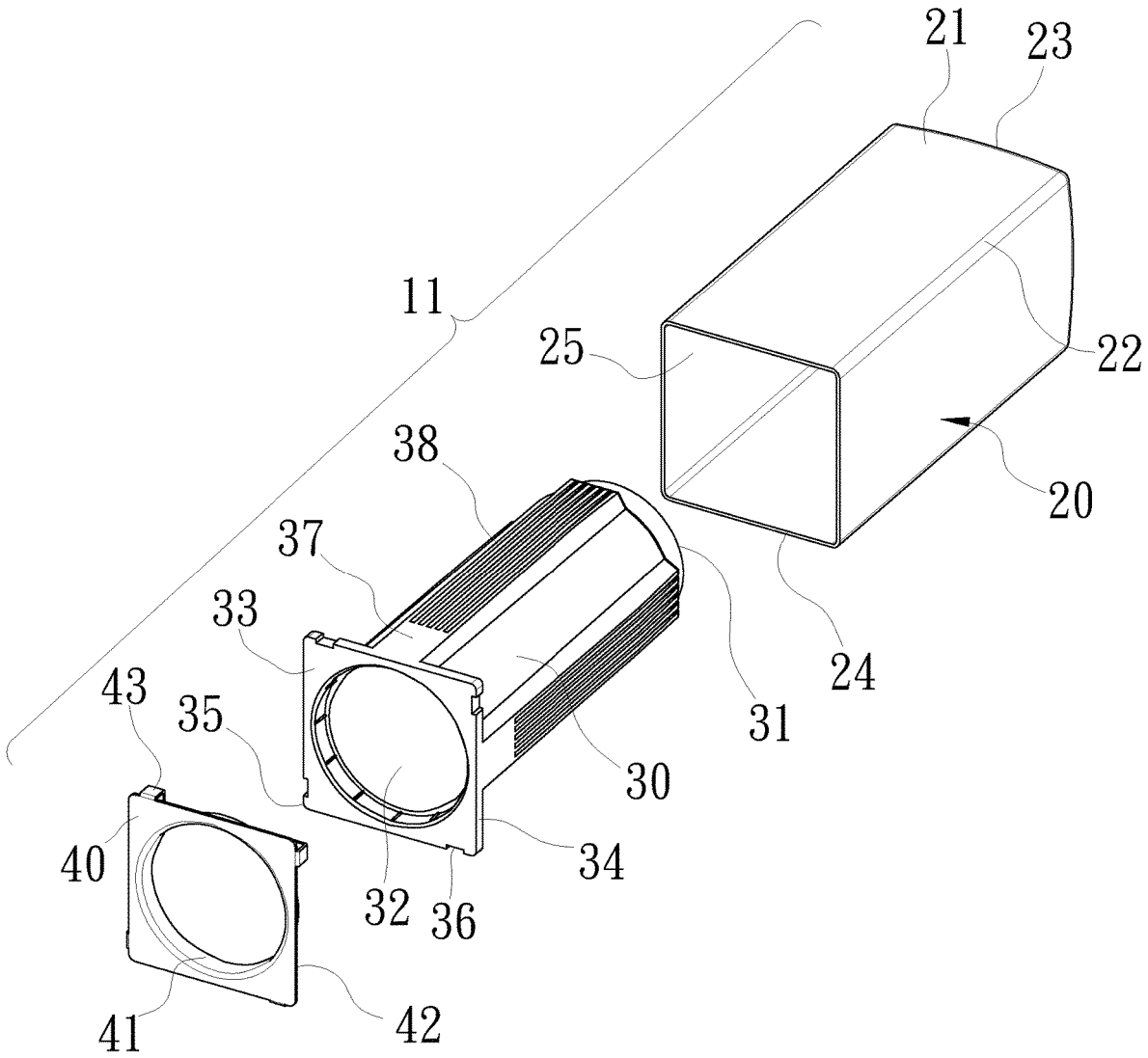
FIG. 2 is an exploded view of the container shown in FIG. 1.

Referring to FIG. 2, the cover assembly 11 includes an external cap 20, an internal cap 30 and a ferromagnetic element 40. The external cap 20 includes four walls 21 extending around a space 25 in the external cap 20. The external cap 20 further includes four bent portions 22. Two adjacent ones of the walls 21 meet each other at each of the bent portions 22 of the external cap 20. The external cap 20 includes a closed end 23 (FIG. 3) and an open end 24 that allows access to the space 25.

The internal cap 30 includes a closed end 31, an open end 32 that allows access to a space in the internal cap 30, and a flange 33 around the open end 32 of the internal cap 30. The flange 33 includes four edges 34 and four corners 35. Adjacent two of the edges 34 meet each other at each of the corners 35. Each of the edges 34 includes a cutout 36. The internal cap 30 includes four thickened portions 37 on an external face. Each of the thickened portions 37 includes a section extending to the flange 33 and another section formed with ribs 38 extending to the closed end 31.

The profile of the ferromagnetic element 40 is similar to the profile of the flange 33. Preferably, the ferromagnetic element 40 is a plate including four edges 42 corresponding to the edges 34. Each of the edges 42 includes a bent tab 43 corresponding to the cutout 36 of one of the edges 34. The ferromagnetic element 40 further includes an annular portion 41. The annular portion 41 and the bent tabs 43 extend from a same face of the ferromagnetic element 40.

Figure 3:
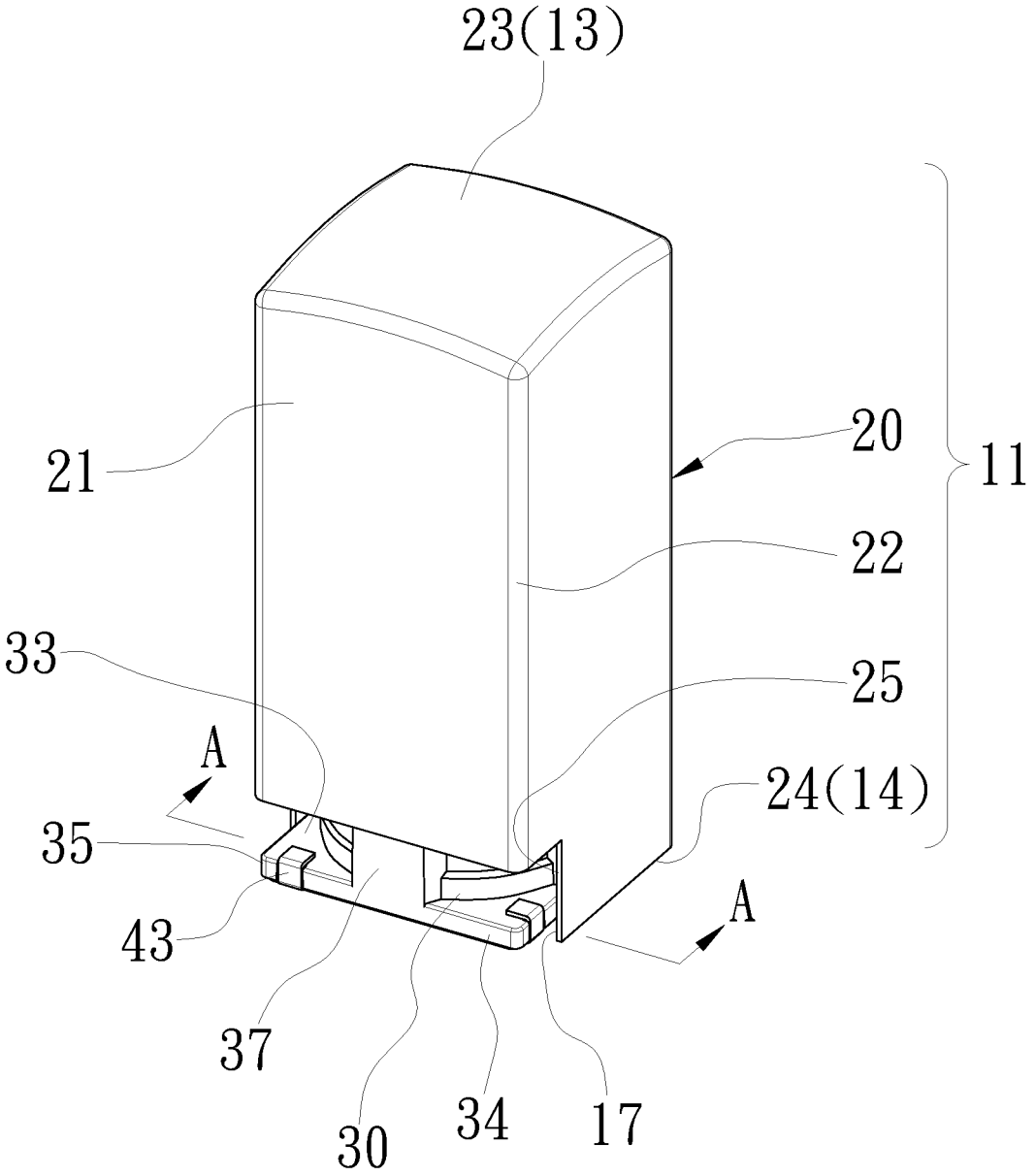
FIG. 3 is a cut-away view of a cap of the container shown in FIG. 1.
Figure 4:
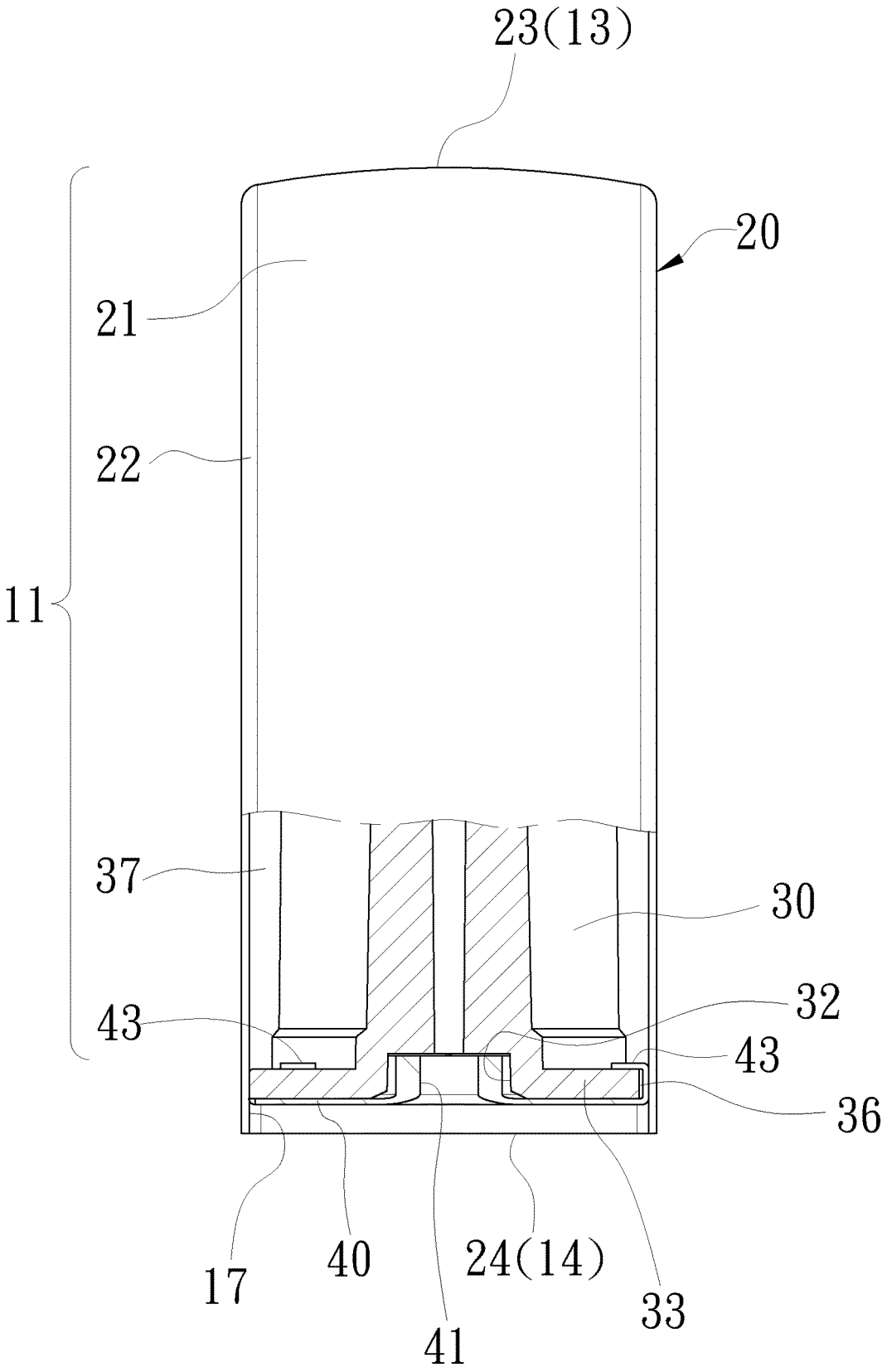
FIG. 4 is a cross-sectional view of the cap taken along a line A-A shown in FIG. 3.

Referring to FIGS. 3 and 4, the ferromagnetic element 40 is connected to the internal cap 30 before the internal cap 30 is connected to the external cap 20. The bent tabs 43 are inserted in the cutouts 36 so that the bent tabs 43 hook the flange 33 to connect the ferromagnetic element 40 to the internal cap 30. Each of the bent tabs 43 includes a first portion extending parallel to an axis of the ferromagnetic element 40 and a second portion extending toward the axis of the ferromagnetic element 40. The length of the first portion of each of the bent tabs 43 is marginally longer than the thickness of the flange 33. The first portion of each of the bent tabs 43 is inserted in one of the cutouts 36 when the second portion of each of the bent tabs 43 is abutted against a rear face of the flange 33 to keep the ferromagnetic element 40 in contact with a front face of the flange 33.

Preferably, the depth of each of the cutouts 36 is larger than the thickness of each of the bent tabs 43 so that the cutouts 36 completely receive the bent tabs 43 to keep the bent tabs 43 from the walls 21 of the external cap 20. Thus, the bent tabs 43 do not interfere with the insertion of the flange 33 in the space 25.

The annular portion 41 of the ferromagnetic element 40 is inserted in the internal cap 30 through the open end 32 of the internal cap 30, around which the flange 33 extends, when the ferromagnetic element 40 is connected to the internal cap 30. Preferably, the length of the annular portion 41 of the ferromagnetic element 40 is larger than the thickness of the flange 33.

The closed end 31 of the internal cap 30 is inserted in the space 25 of the external cap 20 via the open end 24 of the external cap 20. Each of the thickened portions 37 of the internal cap 30 abuts against an internal face of one of the walls 21 so that the internal cap 30 is fitted in the external cap 20. Thus, the combination of the flange 33 with the ferromagnetic element 40 is inserted in the space 25, adjacent to the open end 24 of the external cap 20. Now, the closed end 23 of the external cap 20 is deemed the closed end 13 of the cover assembly 11. The open end 24 of the external cap 20 is deemed the open end 14 of the cover assembly 11.

Figure 5:
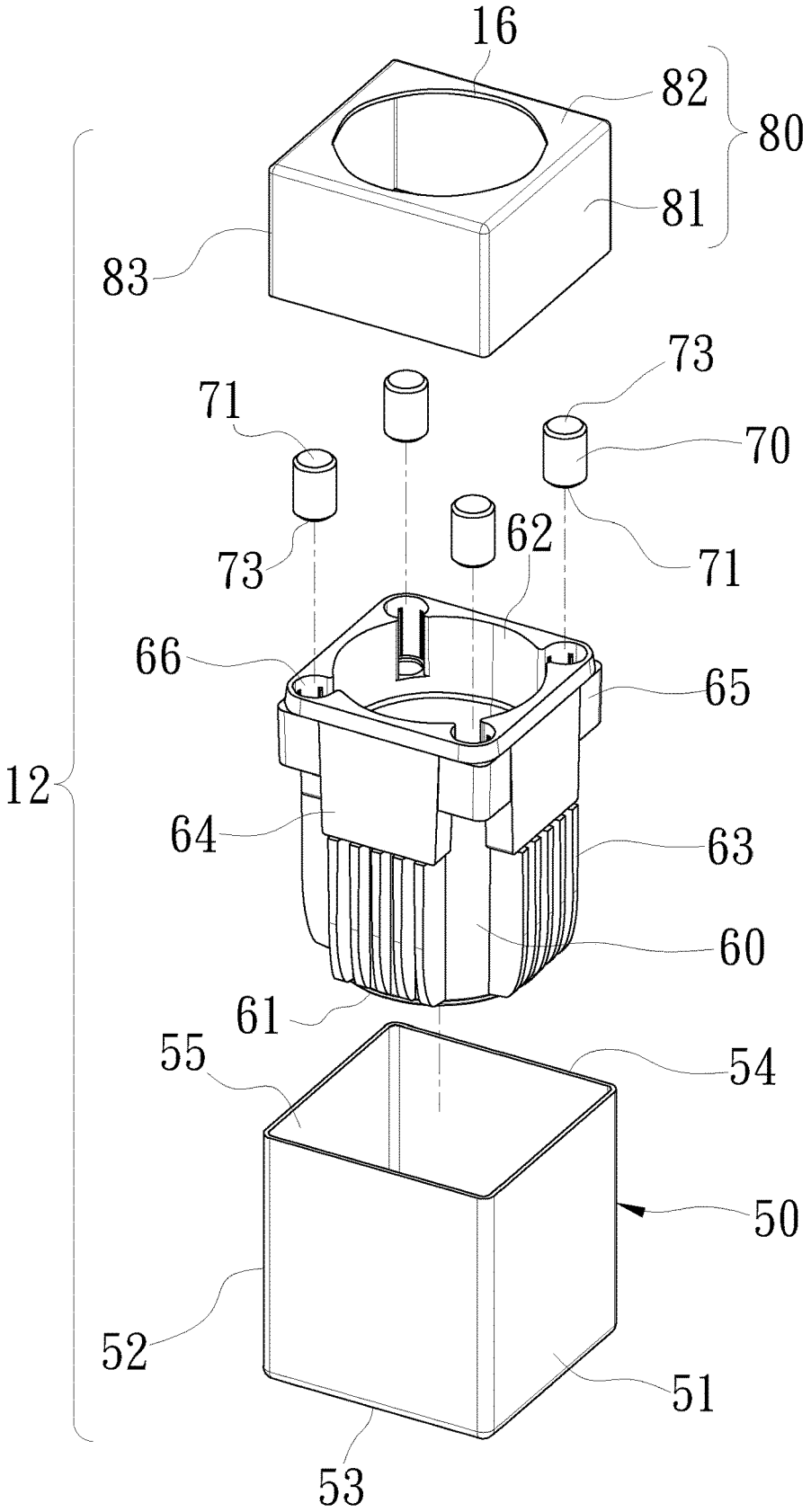
FIG. 5 is an exploded view of a cup of the container shown in FIG. 1.

Referring to FIG. 5, the base assembly 12 includes an external cup 50, an internal cup 60 and a shield 80. The external cup 50 includes four walls 51 extending around a space 55 of the cup 50. The external cup 50 includes a closed end 53 and an open end 54 that allows access to the space 55 of the external cup 50. The external cup 50 further includes four bent portions 52. Each of the bent portions 52 is a portion of the external cup 50 where two adjacent ones of the walls 51 meet each other. The bent portions 52 of the external cup 50 increase the strength of the external cup 50.

The internal cup 60 includes a closed end 61 and an open end 62 that allows access to a space in the internal cup 60. The internal cup 60 further includes four thickened portions 64 and four corner blocks 65. Each of the corner blocks 65 is formed between two adjacent ones of the thickened portions 64 of the internal cup 60. The corner blocks 65 can be deemed thickened portions of the internal cup 60, similar to the thickened portions 64 except for in different positions. The thickened portions 64 and the corner blocks 65 are located closer to the open end 62 of the internal cup 60 than to the closed end 61. Each of the thickened portions 64 includes a section extending to the open end 62 of the internal cup 60 and another section formed with ribs 63 extending to the closed end 61. Each of the corner blocks 65 includes a recess 66 and ridges 67 are formed on a wall of the recess 66.

The shield 80 includes four walls 81 extending from an annular strip 82. An opening 16 is made in a center of the annular strip 82.

Figure 6:
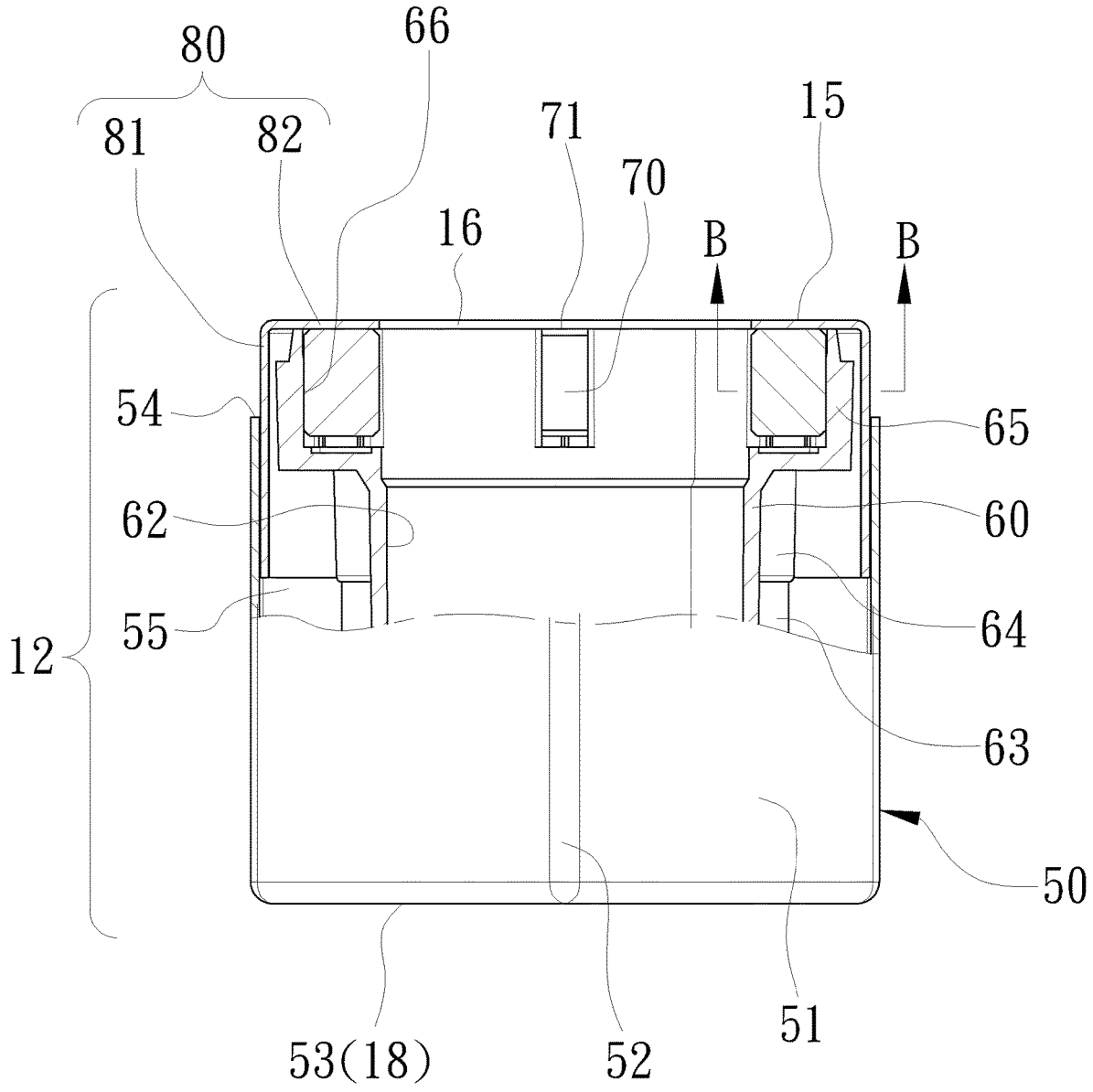
FIG. 6 is a cross-sectional view of the cup taken along a line B-B shown in FIG. 5.
Figure 7:
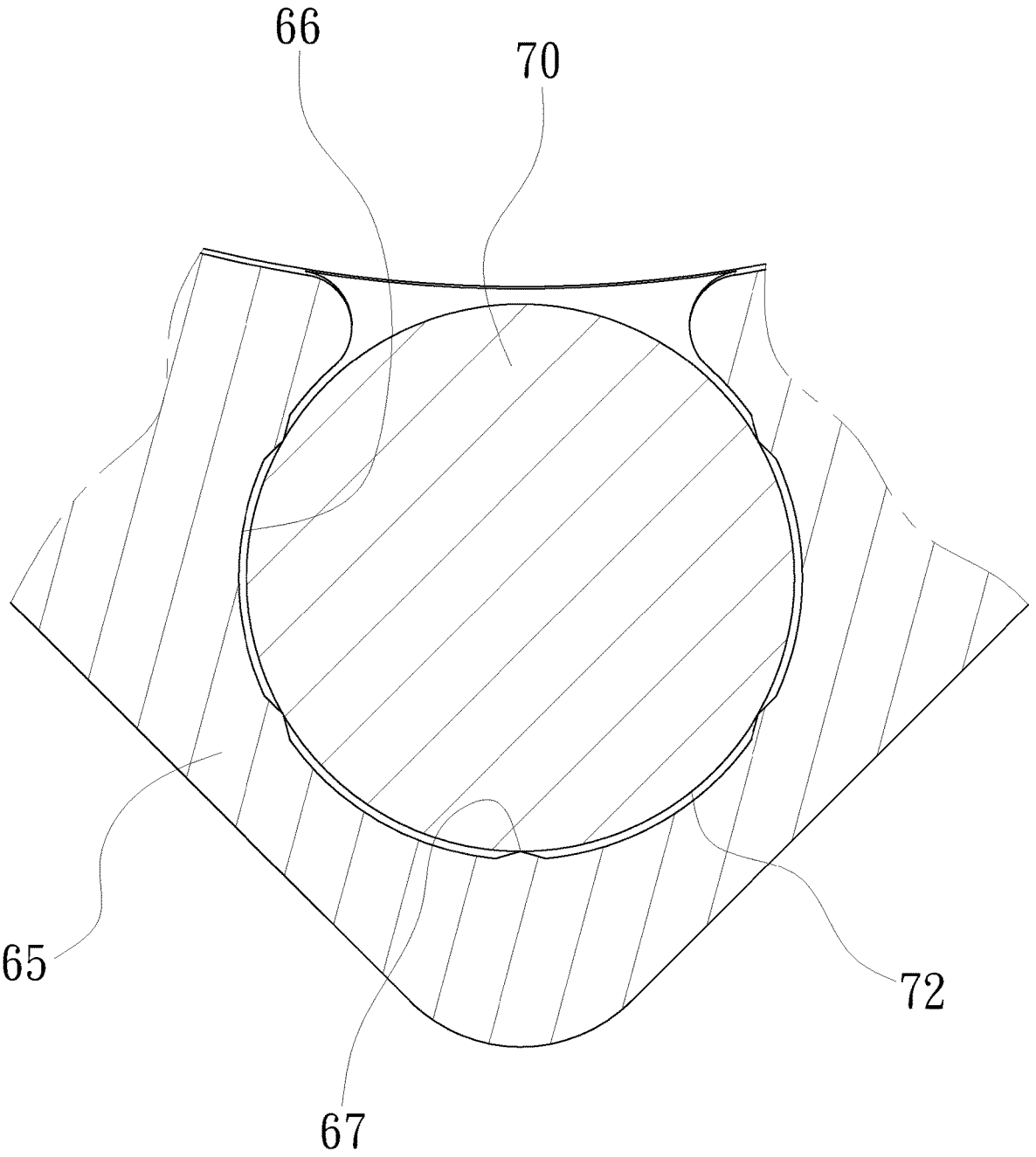
FIG. 7 is an enlarged partial view of the cup shown in FIG. 6.

Referring to FIGS. 5 through 7, the closed end 61 of the internal cup 60 is inserted in the space 55 of the external cup 50 through the open end 54 of the external cup 50. Now, an upper section of the internal cup 60 is located out of the space 55 of the external cup 50. The ribs 63 abut against the walls 51 so that the internal cup 60 is fitted in the external cup 50. The recesses 66 receive magnets 70. The ridges 67 abut against peripheries 72 of the magnets 70 so that the magnets 70 are fitted in the recesses 66.

The shield 80 is located on the internal cup 60 so that the former covers the thickened portions 64 and the corner blocks 65 of the latter. The thickened portions 64 of the internal cup 60 are abutted against the walls 81 of the shield 80 so that the upper section of the internal cup 60 is fitted in the shield 80. The walls 81 of the shield 80 are abutted against the walls 51 of the external cup 50 so that a lower section of the shield 80 is fitted in the external cup 50. That is, the internal cup 60 is kept in the external cup 50 by the shield 80. Now, the annular strip 82 of the shield 80 extends above the open end 54 of the external cup 50. The opening 16 of the annular strip 82 is in communication with the open end 62 of the internal cup 60. The opening 16 of the annular strip 82 is deemed the open end 15 of the base assembly 12.

The corner blocks 65 of the internal cup 60 are aligned to the bent portions 83 of the shield 80 which are in turn aligned to the bent portions 52 of the external cup 50. Thus, the external cup 50, the internal cup 60 and the shield 80 are not rotatable relative to one another.

The magnets 70 are located beneath the annular strip 82. Each of the magnets 70 inherently includes two magnetic poles 71 and 73. The magnetic pole 71 or 73 of each of the magnets 70 is in contact with the annular strip 82. It does not matter which of the magnetic poles 71 and 73 of each of the magnets 70 is in contact with the annular strip 82 for a reason to be given.

Referring to FIG. 8 again, the ferromagnetic element 40 is located at the open end 14 of the cover assembly 11. The magnets 70 are located at the open end 15 of the base assembly 12. The magnets 70 magnetically attract the ferromagnetic element 40 to keep the cover assembly 11 on the base assembly 12. It does not matter which of the magnetic poles 71 and 73 of each of the magnets 70 is located adjacent to the ferromagnetic element 40, each of the magnets 70 magnetically attracts the ferromagnetic element 40. There is no magnetic repulsion between the ferromagnetic element 40 and each of the magnets 70 because the ferromagnetic element 40 alone does not generate magnetism.

The bent portions 22 of the external cap 20 are aligned to the bent portions 83 of the shield 80 so that the cover assembly 11 is not rotatable relative to the base assembly 12. Now, the open end 14 of the cover assembly 11 is aligned to the open end 15 of the base assembly 12 so that the space of the cover assembly 11 is in communication with the space of the base assembly 12. The combination of the space of the cover assembly 11 with the space of the base assembly 12 is used to receive cosmetics such as a lipstick.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A container comprising:

a cover assembly;

a ferromagnetic element fitted in the cover assembly;

a base assembly comprising:

an external cup;

an internal cup extending in the external cup and comprising a thickened portion formed with recesses and fitted in the shield, wherein each of the recesses comprises a closed end and an open end;

magnets inserted in the recesses, wherein the magnets are operable to magnetically attract the ferromagnetic element to keep the cover assembly covering the base assembly; and a shield comprising:

a wall comprising extending between the external cup and the thickened portion of the internal cup; and an annular strip extending transversely at an end of the wall and covering the open ends of the recesses so that the magnets are kept in position between the annular strip and the closed end of the recesses.

2. The container according to claim 1, wherein the cover assembly comprises an external cap and an internal cap fitted in the external cap, wherein the ferromagnetic element is connected to the internal cap.

3. The container according to claim 2, wherein the internal cap comprises an open end and a flange extending around the open end of the internal cap, wherein the ferromagnetic element is connected to the flange.

4. The container according to claim 2, wherein the ferromagnetic element comprises bent tabs for hooking the flange to connect the ferromagnetic element to the internal cap.

5. The container according to claim 2, wherein the ferromagnetic element comprises an annular portion inserted in the internal cap via the open end of the internal cap.

6. The container according to claim 5, wherein the ferromagnetic element comprises bent tabs for hooking the flange to connect the ferromagnetic element to the internal cap.

7. The container according to claim 1, wherein the internal cup further comprises ridges extending on a wall of each of the recesses to abut against a periphery of one of the magnets.

* * * * *